US006725811B1

(12) United States Patent
Moore, Jr. et al.

(10) Patent No.: US 6,725,811 B1
(45) **Date of Patent: *Apr. 27, 2004**

(54) WATER HEATER WITH LOW $NO_X$ FIBER MATRIX BURNER

(75) Inventors: H. Jack Moore, Jr., Playa Del Ray, CA (US); Martin Abalos, Pomona, CA (US)

(73) Assignee: American Water Heater Company, GA (US)

( * ) Notice: Subject to any disclaimer, the term of this patent is extended or adjusted under 35 U.S.C. 154(b) by 1788 days.

This patent is subject to a terminal disclaimer.

(21) Appl. No.: 08/590,355

(22) Filed: Jan. 11, 1996

Related U.S. Application Data

(63) Continuation of application No. 08/333,871, filed on Nov. 3, 1994, now Pat. No. 5,511,516, which is a continuation of application No. 08/113,618, filed on Aug. 27, 1993, now abandoned.

(51) Int. Cl.[7] ..... F24H 1/00

(52) U.S. Cl. ..... 122/13.01; 122/17.1; 122/17.2; 122/18.31; 431/328

(58) Field of Search ..... 122/14, 17, 19, 122/13.01, 17.1, 17.2, 18.31; 126/361, 92 AC; 431/326, 328

(56) References Cited

U.S. PATENT DOCUMENTS

| | | | | |
|---|---|---|---|---|
| 2,479,042 A | | 8/1949 | Gaines | |
| 3,161,227 A | | 12/1964 | Goss et al. | |
| 3,947,229 A | | 3/1976 | Richter | |
| 4,432,727 A | | 2/1984 | Fraioli | |
| 4,510,890 A | * | 4/1985 | Cowan | 122/17 |
| 4,519,770 A | * | 5/1985 | Kesselring et al. | 431/328 |
| 4,639,213 A | * | 1/1987 | Simpson | 431/326 |
| 4,766,883 A | | 8/1988 | Cameron et al. | |
| 4,838,208 A | | 6/1989 | Stubbe et al. | |
| 4,867,106 A | | 9/1989 | Staats | |
| 4,869,232 A | | 9/1989 | Narang | |
| 5,049,065 A | | 9/1991 | Smith et al. | |
| 5,240,411 A | | 8/1993 | Abalos | |
| 5,317,992 A | * | 6/1994 | Joyce | 122/14 |

OTHER PUBLICATIONS

Consumers' Research Bulletin, Aug., 1955, pp. 23–26.*

* cited by examiner

*Primary Examiner*—Jiping Lu
(74) *Attorney, Agent, or Firm*—Piper Rudnick LLP

(57) ABSTRACT

A water heater having improved operating characteristics and lower costs of manufacturing is described. The water heater has an unified combustion chamber and burner construction with a ceramic fiber matrix burner.

7 Claims, 7 Drawing Sheets

WATER HEATER WITH LOW $NO_X$ FIBER MATRIX BURNER

This application is a continuation of application Ser. No. 08/333,871, filed on Nov. 3, 1994, now U.S. Pat. No. 5,511,516 which is a continuation of prior application Ser. No. 08/113,618, filed Aug. 27, 1993, now abandoned.

The present invention relates to an improved construction for a gas water heater and particularly to a unified burner and combustion chamber construction and a low NO ceramic burner.

BACKGROUND OF THE INVENTION

Water heaters are commonly employed in homes and small businesses to heat water for domestic use. Water heaters are produced in large numbers and sold to consumers in a very competitive market. A large portion of these devices use gaseous fuel, such as natural gas or bottled gas, as an energy source.

Conventional gas fired water heaters often include a tank adapted to contain a body of water, a water inlet, a water outlet, a combustion chamber disposed below or within the tank, a gas regulator and a burner disposed within the combustion chamber. The entire structure is thermally insulated. Conventionally, the gas regulator senses the temperature of water within the tank. When the water temperature drops below a certain minimum, gas is allowed to flow to the burner within the combustion chamber where it is ignited, heating the combustion chamber and the body of water above or around the combustion chamber. The products of combustion are vented through a flue connected to the combustion chamber and passing through the water containing tank. This general construction has been common for many years. Numerous variations upon this construction have been created in attempts to increase efficiency and otherwise improve operating characteristics.

Over the last several years, the efficiency of water heaters, especially fuel efficiency, has become an important characteristic. This is the result of government regulation and also heightened consumer awareness concerning consumption of natural resources. Over recent years, insulation technology has improved insulation characteristics of water heaters. However, production line burner technology has remained comparatively stagnant and, therefore, inefficient. Additionally, concern for the environment has made the elimination of potentially polluting substances from the products of combustion more important. While gas fired water heaters are very low polluters when compared to other fuel consuming products, there are many water heaters. Government bodies and consumers have therefore sought to further reduce the contribution of pollutants emanating from water heaters.

In addition to all of the above very important design criteria, cost is a very important factor in producing water heaters. Water heaters are purchased by builders and home owners in a very competitive environment. The products are mass produced and sold throughout a large marketplace. In the United States, national companies compete very aggressively for sales. Water heaters must therefore be very economically manufactured or they will not sell and consumers will not gain the benefits of design improvements.

In conventional water heaters, the above objects are not optimally achieved. Additionally, the cost of manufacturing remains high. A number of different components including a tank, a combustion chamber, a burner, a reflecting pan under the burner to protect the bottom of the water heater from burner heat and numerous other elements and insulation are manufactured and assembled. Often, changing a design to address one of the above identified problems compromises another of the problems or increases cost significantly.

OBJECTS OF THE INVENTION

An object of the invention is to provide a water heater of improved operating characteristics which is inexpensive to manufacture on a production basis.

It is another object of the present invention to provide a water heater which has reduced emissions of oxides of nitrogen.

It is still another object of the present invention to provide a water heater of improved fuel efficiency and having low standby heat loss.

It is yet another object of the present invention to provide a water heater which consumes less materials in production and is less expensive to manufacture.

It is still another object of the present invention to provide a water heater having cooler external surfaces around the combustion chamber whereby special insulation techniques are not required and which economically extracts the maximum amount of heat from flue gasses.

Further objects and advantages to the invention will appear from the following detailed description of a preferred embodiment thereof and from the accompanying drawings.

SUMMARY OF THE INVENTION

The present invention contemplates a new and improved water heater construction which overcomes the above referred to problems and others and provides a water heater of simpler construction which is economical to manufacture, economical to operate, burns fuel cleanly and answers governmental regulations.

Briefly stated, in accordance with one aspect of the invention, a water heater is provided having a tank adapted to contain a body of water and an integrated combustion chamber and ceramic burner assembly below the tank.

Still further in accordance with the invention, a skirt generally matching the cross section of the tank is positioned below the tank and gas tightly fixed to the tank. A burner shelf is positioned within this skirt and gas tightly fixed to the skirt around its entire periphery. A ceramic burner is positioned on the burner shelf separating the volume within the skirt into a combustion chamber above the burner shelf and a burner volume below the burner shelf. A bottom pan is gas tightly sealed to the skirt around its bottom forming a gas tight burner chamber below the burner shelf. An air and gas proportioner communicates through the skirt and into the burner chamber in a gas tight manner.

DETAILED DESCRIPTION OF THE INVENTION

Figure 1:
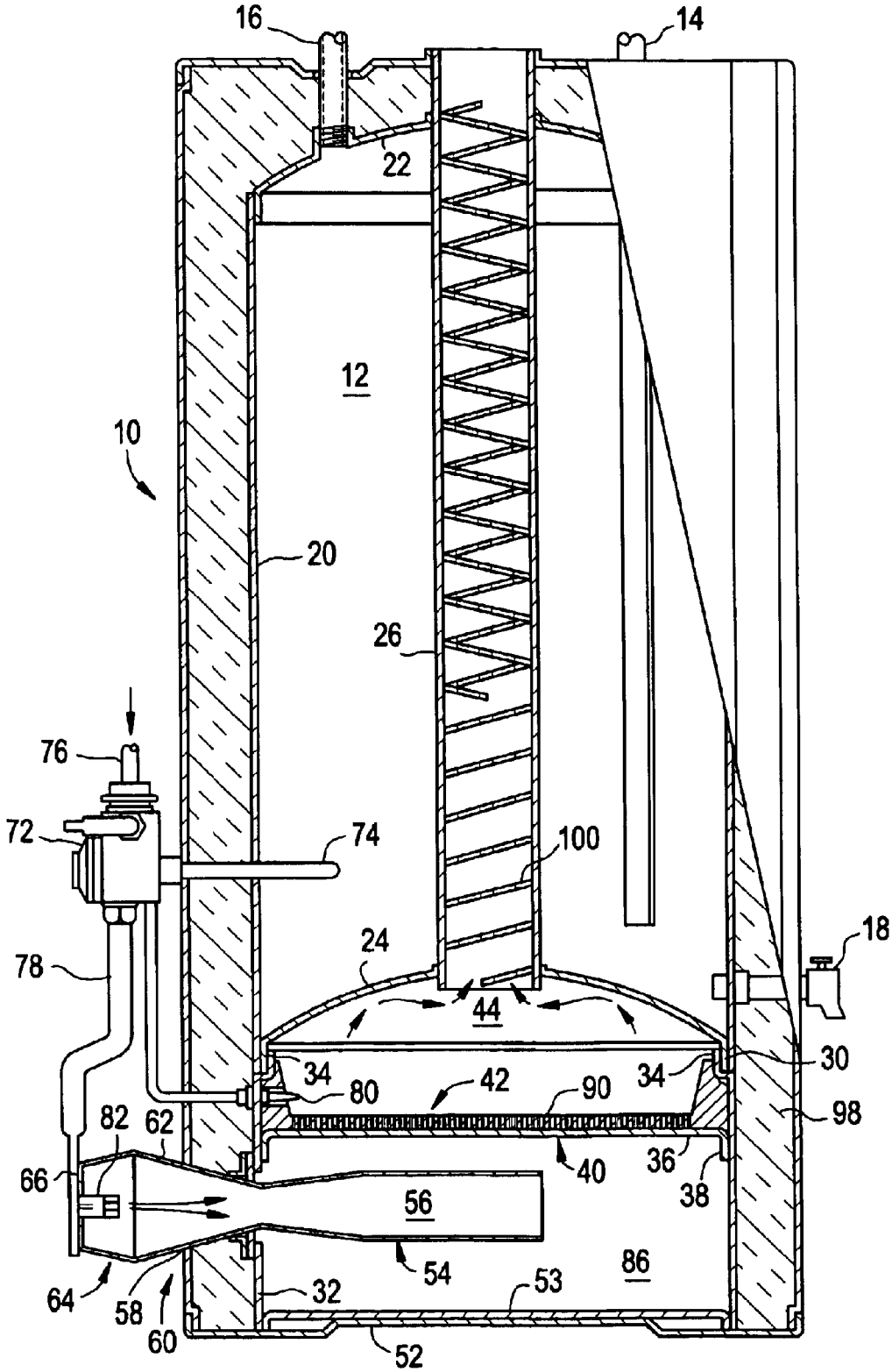
FIG. 1 is a side elevational view of a water heater in accordance with the invention, mostly cut-away to the center line of the flue.
Figure 2:
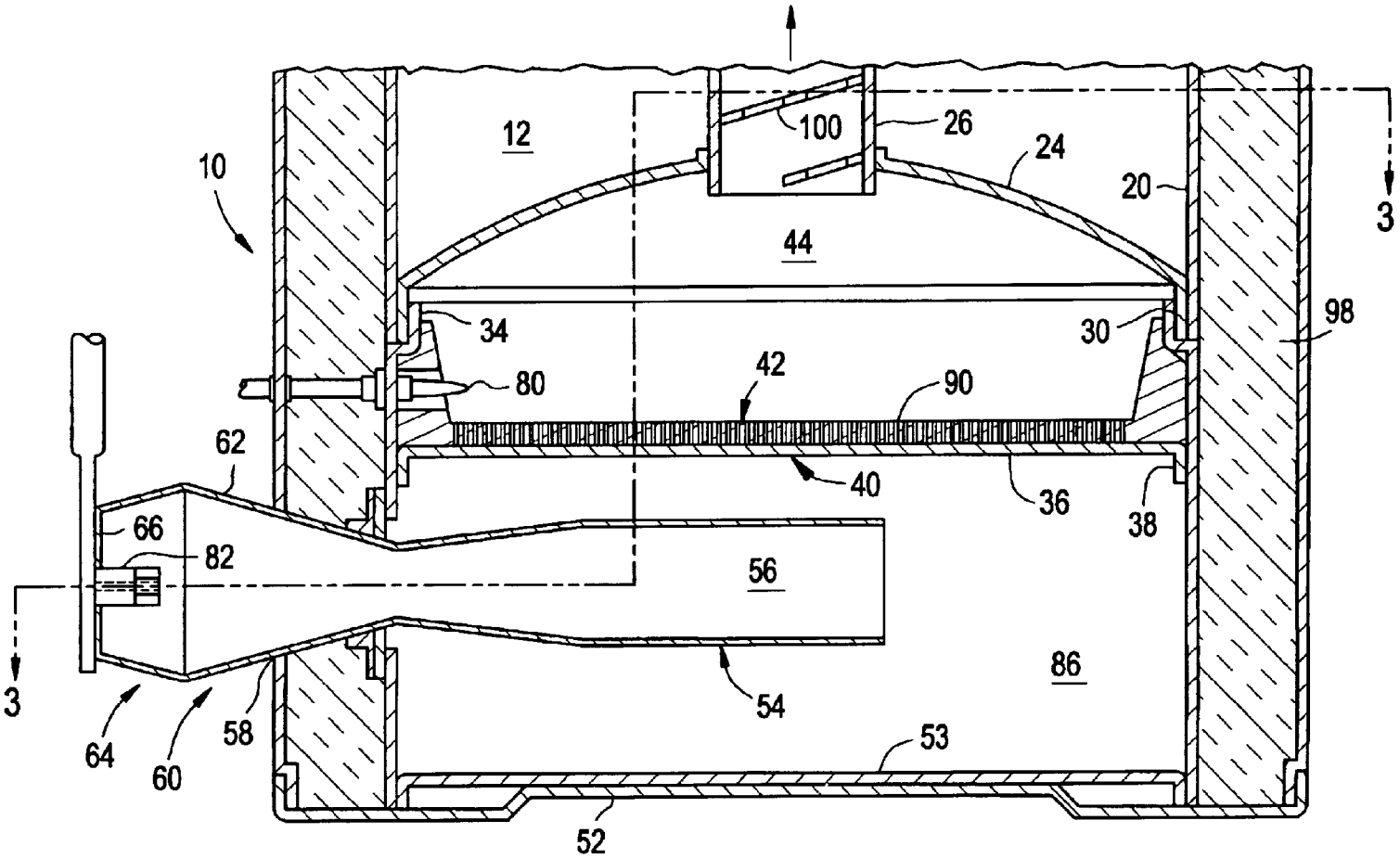
FIG. 2 is an enlarged detail drawing of the combustion chamber burner area of the water heater shown in FIG. 1.
Figure 3:
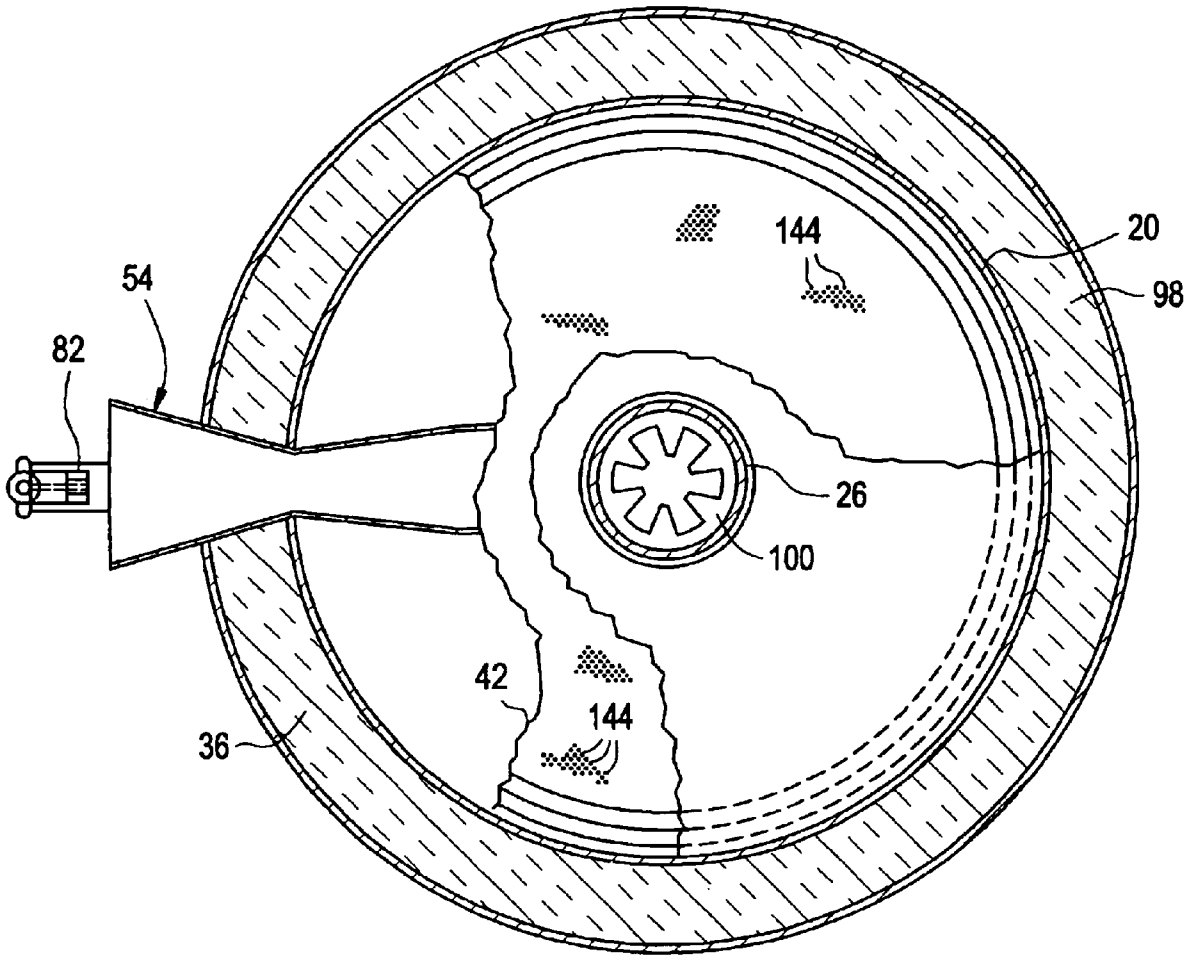
FIG. 3 is a downward looking cross-sectional view taken along line 3—3 of FIG. 2 showing details of the burner construction.

Referring now to the drawings wherein the structures shown are for purposes of illustrating the embodiments of the invention and not for the purposes of limiting same, the figures generally, and FIGS. 1 and 2 in particular, show a water heater 10 comprised of a tank 12 adapted to contain a body of water having an inlet 14 and an outlet 16. A conventional drain 18 is also provided. Tank 12 has a cylindrical side wall 20, a dome-shaped top 22, water tightly fixed to side wall 20 and a bottom wall 24. A cylindrical flue 26 containing baffles 100 passes through the center of tank 12 and communicates with the space below bottom wall 24. Flue 26 having baffles 100 is conventionally connected to a conduit which conduct products of combustion from the flue out of the building in which the water heat is located.

Bottom wall 24 is provided with a downwardly extending cylindrical flange 30 around its entire periphery. This flange 30 is permanently fixed to tank side wall 20 by means of welding or the like. A cylindrical skirt 32 is positioned below tank 12. Skirt 32 is provided with either a reduced portion 34 or an enlarged portion (not shown) which engages the bottom of tank 12. In the embodiment shown, reduced portion 34 is permanently fixed to the inside surface of flange 30 of bottom wall 24. Welding or the like provides a permanent gas tight joint between reduced portion 34 and flange 30.

A ring-shaped burner shelf 36 is provided with a flange 38 which is air tightly fixed to skirt 32 below the reduced portion 34. Burner shelf 36 is provided with a central opening 40 which is covered by a burner 42. A combustion chamber 44 is defined by tank bottom wall 24, the top portions of skirt 32, burner shelf 36 and burner 42. The combustion chamber 44 is air tight other than through the burner 42 and the flue 26. A disc-shaped burner bottom pan 52 is provided at the bottom of skirt 32. Burner bottom pan 52 is either provided with a flange 53 allowing attachment to the skirt 32 or is formed integrally with skirt 32. In either embodiment, burner bottom pan 52 is joined to skirt 32 in an air tight manner. Skirt 32 is pierced on one side by an air and fuel proportioner 54. Air and fuel proportioner 54 is comprised of a tube 56 mounted in a circular opening 58. Tube 56 is open at its inboard end 60. Tube 56 is provided with a conical enlarging portion 62 near its outboard end 64. The outboard end 64 is also provided with an open drape portion 66. As can be best seen in FIG. 2, drape portion 66 connects to the top half of the outboard end of tube 56 and to the bottom half end of tube 56.

A thermostat 72 senses the temperature of the body of water contained in tank 12 by means of a sensor 74. Thermostat 72 receives gas through a supply line 76 and provides gas through a gas line 78 to air and fuel proportioner 54. Thermostat 72 also controls the operation of igniter 80 located in combustion chamber 44. When thermostat 72 senses low water temperature, it provides gas to air and fuel proportioner 54 through a nozzle 82. Gas and air are drawn through tube 56 into burner chamber 86 defined by the lower portion of skirt 32, burner shelf 36, burner 42 and burner bottom pan 52. The air and fuel mixture flows through burner 42 and is combusted at the top surface 90 of burner 42.

Burner 42, shown in FIGS. 1–5, comprises a one-piece, fiber matrix construction resembling ceramic. Burner 42 is non-metallic and approximately one-half inch thick. A single structure comprised of a fiber matrix having a multiplicity of regularly arrayed ports 144 having a diameter of about 0.076 inches is provided. The ports account for approximately one-third the surface area 90 of fiber matrix burner 42. Burner 42 is preferably ported over its entire area except for a peripheral area used for attachment to burner shelf 36. The turbulation in burner chamber 86 caused by rapidly moving fuel and air, and associated mixing action, results in an even distribution of fuel and air against the bottom surface of burner 42. This permits a substantially even flow of fuel/air mixture through ports 144. The fuel and air flows through ports 144 and out of burner 42 at burner top surface 90 and is consumed, producing heat along burner top surface 90. Heat is radiated from a combustion zone above burner top surface 90 in a pattern following the surface contour of burner top surface 90.

Figure 4:
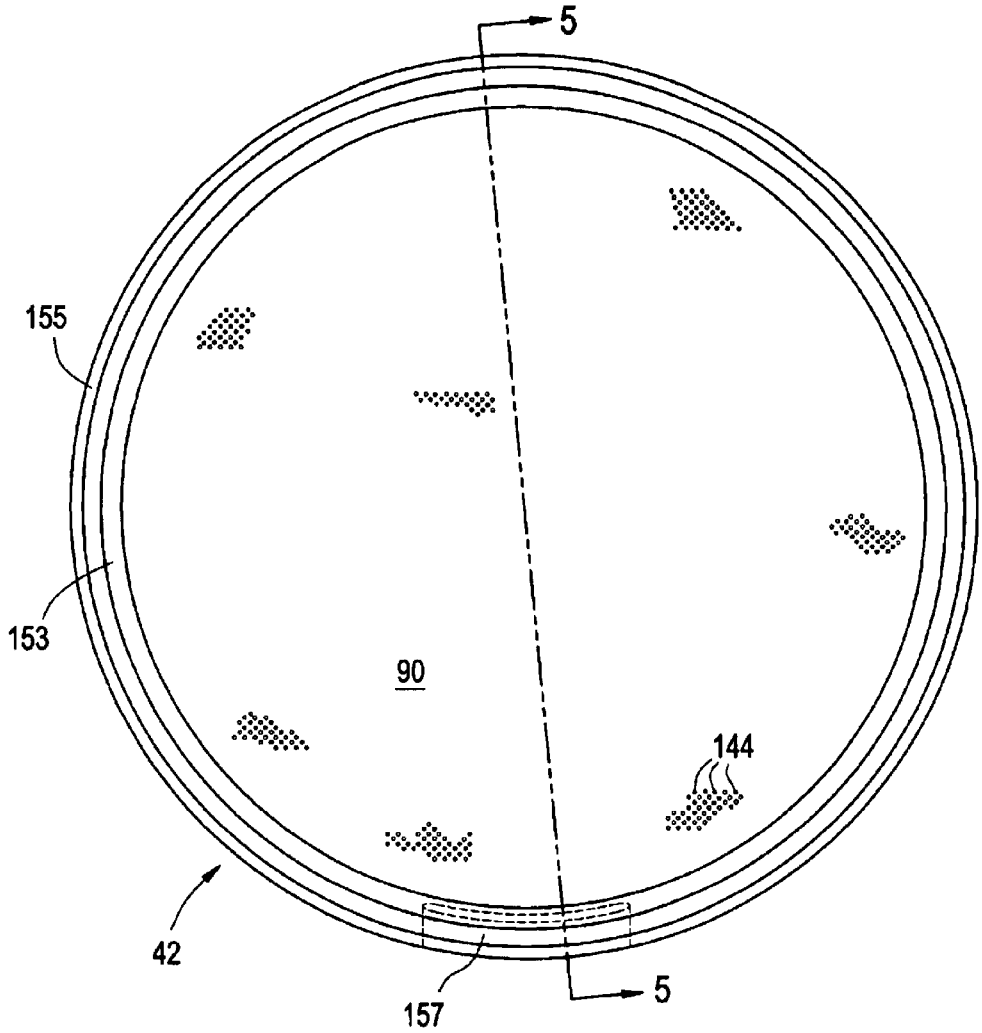
FIG. 4 is a top plan view of the burner shown in FIGS. 1–3.
Figure 5:
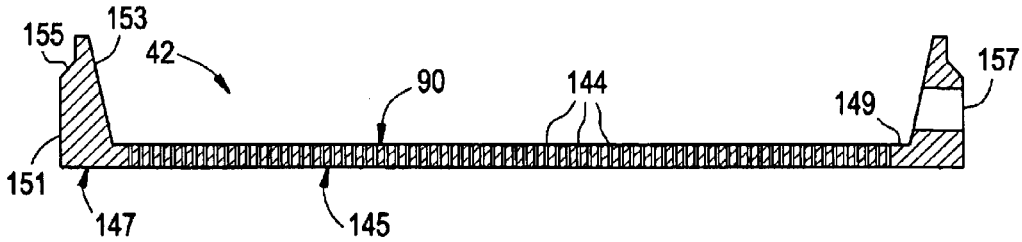
FIG. 5 is a cross sectional view taken along line 5—5 of FIG. 4.

FIGS. 4 and 5 show particular aspects of burner 42 in one preferred embodiment selected for illustration. Burner 42 includes a central combustion disc 145 and a peripheral flange 147. Central combustion disc 145 includes ports 144 and a disc edge portion 149. Disc edge portion 149 connects to flange 151. Flange 151 includes a sloped inner wall 153 and an exterior wall 155. Exterior wall 155 is shaped and configured to closely conform to the upper portion of skirt 32 and, in particular, to conform to reduced portion 34, thereby providing a tight fit. Flange 151 also contains a pilot opening 157 through which igniter 80 (FIG. 1) extends inwardly toward central combustion disc 145. It should be noted that although burner 42 shown in FIGS. 4 and 5 is depicted as a single integral burner, multiple piece burners 42 are within the scope of the invention. For example, central combustion disc 145 and peripheral flange 147 can be made separately for ease of manufacture. Similarly, the material of manufacture for central combustion disc 145 and peripheral flange 147 could be different, although employing the same material is preferred. Further, burner 42 may be molded or cast or formed by any of a number of processes.

Figure 6:
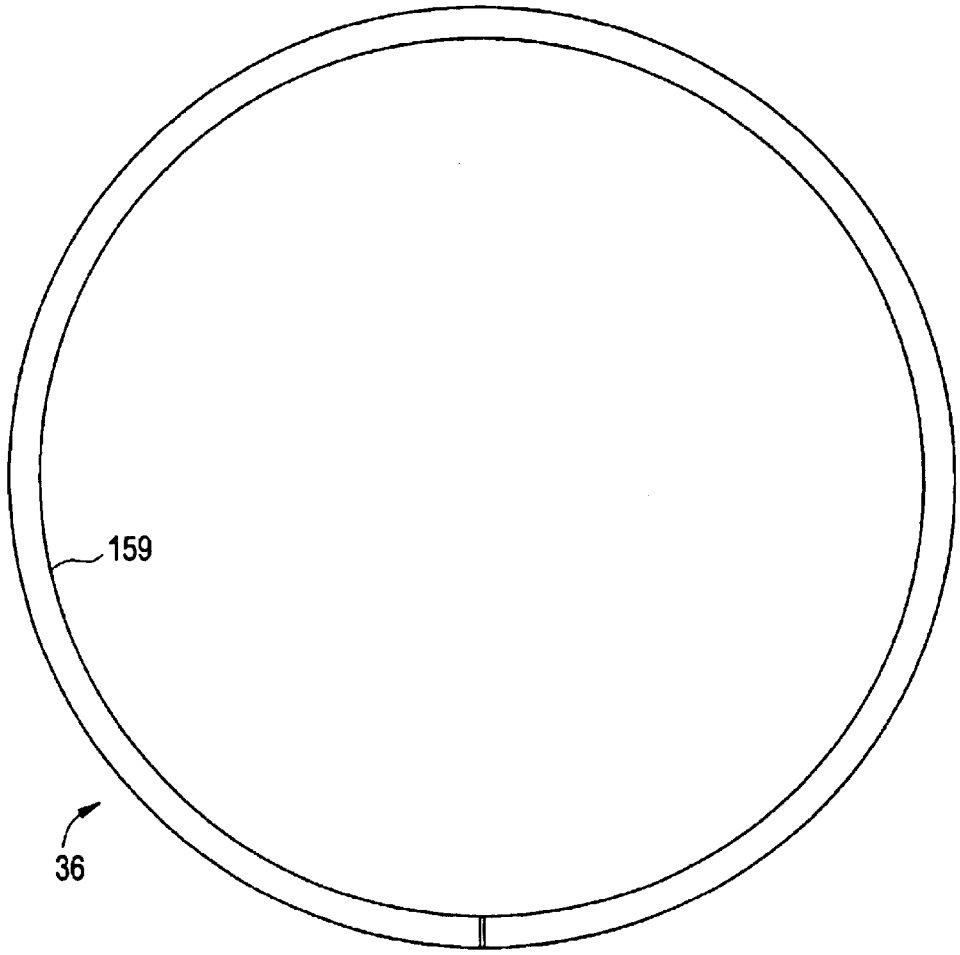
FIG. 6 is a top plan view of a burner shelf used in accordance with the invention.
Figure 7:
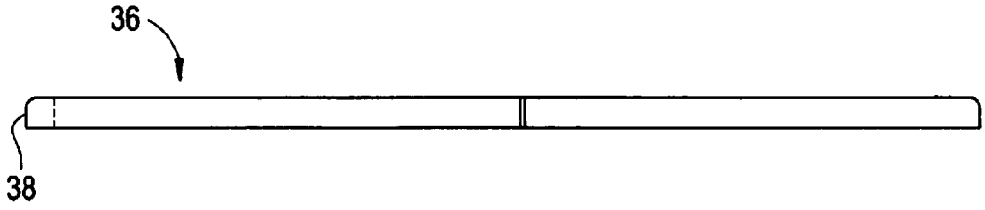
FIG. 7 is a side elevational view of the shelf shown in FIG. 6.

FIGS. 6 and 7 show burner shelf 36 from top plan and side elevational views. Burner shelf 36 includes a vertically oriented flange 38 that is air tightly fixed to skirt 32. Burner shelf 36 further includes a horizontally oriented ledge 159 upon which burner 42 rests. In particular, the bottom surface of peripheral flange 147 rests on ledge 159.

Burner top surface 90 provides a pattern of radiation directing the heat of combustion at tank bottom wall 24 and not at skirt 32 as is typical of burners in many water heaters made and sold throughout the United States. This results in at least two significant advantages. First, maximum usable heat is directed to tank 12 containing the water to be heated. Second, the temperature of skirt 32 surrounding combustion chamber 44 is kept low. Moreover, peripheral flange 147 serves as a refractory to severely reduce heat from radiating outwardly of the water heater. Special insulation techniques involving use of high temperature insulation material are therefore not required. Thus, the body of insulation 98 surrounding water tank 12 and combustion chamber 44 can be a single body of foamed in place insulation. In many typical prior art water heaters, foamed in place insulation 98 is used around the tank 12 and a separate body of insulation, such as fiberglass or special heat resistant foam, is used around combustion chamber 44. These extra efforts, different materials and construction techniques, all of which are costly and inefficient, are unneeded.

Figure 8:
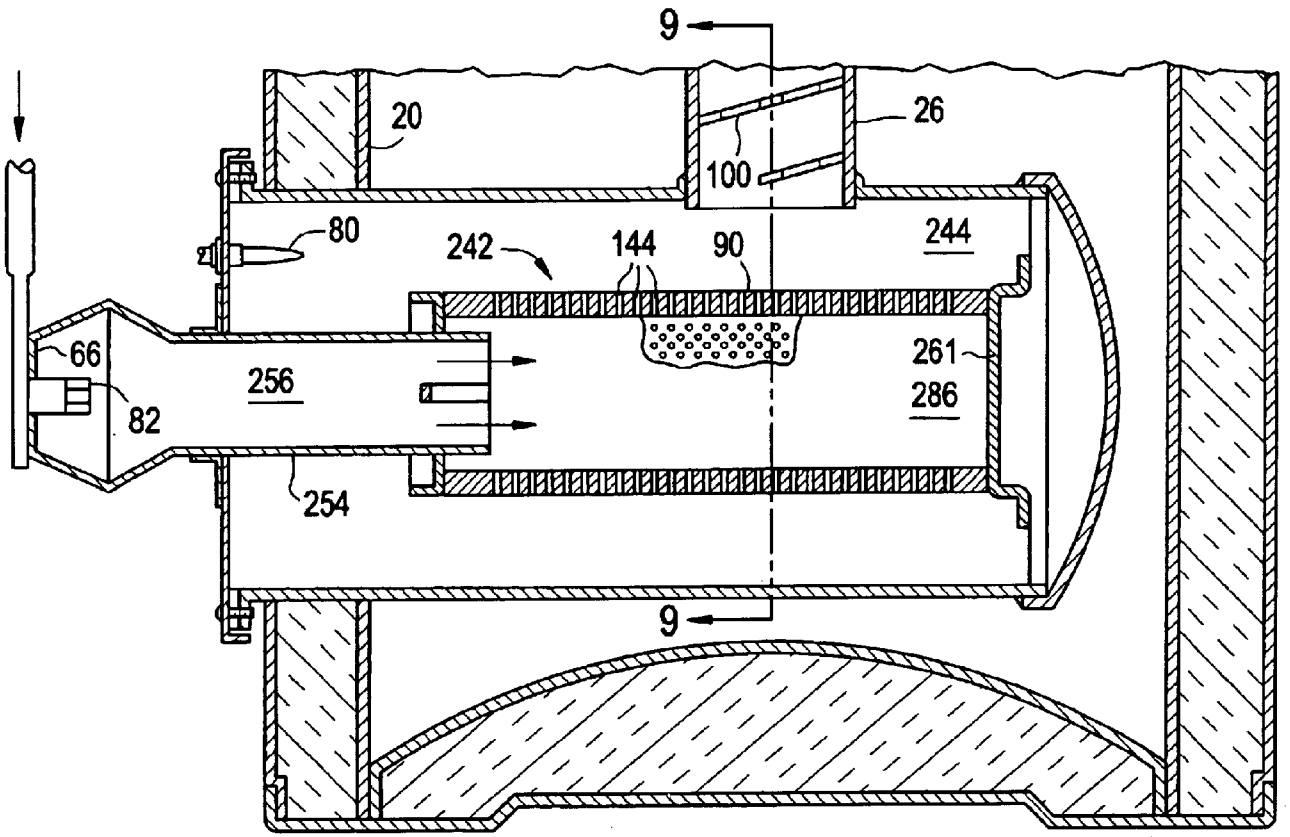
FIG. 8 is a cross-sectional view of the combustion chamber burner area of a submerged combustion type water heater using a burner of the invention.
Figure 9:
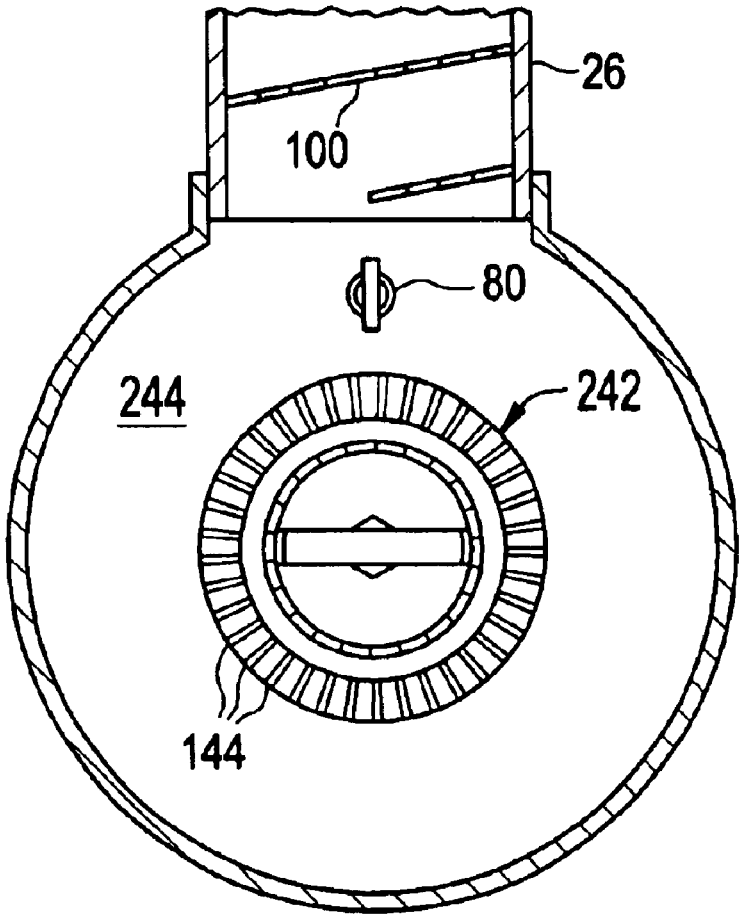
FIG. 9 is a cross-sectional view of the combustion chamber burner area of FIG. 8 taken along the line 9—9 of FIG. 8.

Drape structure 66 is also useful in submerged combustion chamber type water heaters such as that shown in FIGS. 8 and 9. A cylindrical burner 242 is positioned within a cylindrical combustion chamber 244. Burner 242 includes a multiplicity of ports 144 in the same manner as burner 42 previously described. Ports 144 are located around and along the circumference of burner 242, which also has a top surface 90. Burner 242 is fed air and fuel through an air and fuel proportioner 254 similar to air and fuel proportioner 54 previously described. The primary difference resides in the cylindrical burner structure 242 being mounted on the end of the air and fuel proportioner 254. Fuel and air travel through tube 26 and into burner chamber 286. Burner chamber 286 is formed completely on the top and bottom by burner 242 and on the ends by tube 256 on one side and end closure 261 on the other side. Drape 66, nozzle 82, and other elements operate in substantially the same manner. The fuel and air mixture exit ports 144 and top surface 90 where combustion occurs all around the circumference of burner 242. Radiant heat radiates radially outwardly from top surface 90 into contact with tank bottom wall 224.

As can be seen in FIG. 1, the operation of water heater 10, which is apparent to the end user, is similar in many aspects to the operation of the conventional water heater. When hot water is required, thermostat 72 provides fuel to air and fuel proportioner 54 which is burned within combustion chamber 44 and heat extracted in combustion chamber 44 and flue 26. When the water in tank 12 is heated, thermostat 72 interrupts the flow of gas to nozzle 82 and combustion ceases. Because hot water is contained within the tank, a draft through the water heater is maintained and the air and fuel mixture contained within burner chamber 86 is drawn up through burner 42 to be combusted prior to the extinguishing of combustion on the top surface 90 of burner 42.

However, operation of a water heater in accordance with the invention has several significant advantages. Efficiency is improved. Heat is primarily directed to the water containing tank and is not directed to skirt 32 where it would be wasted. Foam of the type used as insulation for tank 12 can be used around the combustion chamber resulting in better insulation and better efficiency. Burner 42 acts as a flame arrester preventing the migration of combustion into burner chamber 86. Drape 66 assists in minimizing the likelihood of the escape of minor amounts of gas when combustion is initiated or terminated. The initial or terminal portion of gas dispensed from nozzle 82 will be contained within tube 56 to be drawn into the water heater by the draft of water heater 10 even when the water heater is not in operation.

Importantly, a water heater constructed in accordance with the present invention is less expensive to manufacture than a conventional water heater. No burner separate from the combustion chamber need be constructed. No radiant heat reflector sheet needs to be positioned below the burner as the burner itself acts to localize radiation of heat upwardly towards the bottom of the water containing tank. Standby losses are also minimized in the current design as only primary air is being used. Primary air is that drawn through the burner for use directly in the combustion process as opposed to secondary air which is drawn around the burner and used to cool the burner as well as sometimes in the combustion process.

The invention has been described with reference to preferred embodiments. Modifications and alterations will occur to others upon the reading and understanding of this specification and it is my intention to include such modifications and alterations insofar as they come within the scope of the appended claims. For example, their materials, shapes and sizes may be substituted for a number of the components of the water heaters shown herein. Metal or plastic jackets may be used. Various types of foam forming insulation materials may be employed. Various foaming techniques and processes may be utilized in addition to different types of water tanks, high efficiency flues, igniters, thermostats, gas control devices and the like.

We claim:

1. An improved water heater comprising an upright cylindrical water tank, a flue pipe extending lengthwise through said tank and the opposite ends of said tank, said pipe being attached to said opposite ends, a cylindrical metal skirt of substantially the same diameter of said tank to support said tank, a circular perforated ceramic flat plate radiant gas burner fitted as a transverse partition in said skirt to provide a combustion zone above said burner and a plenum for gas and air below said burner, said ceramic plate having a diameter substantially equal to the inside diameter of said skirt and having perforations over its entire face except for a narrow rim portion by which it is supported in said skirt, refractory-type insulation surrounding said perforations as lining of said skirt between said rim portion and the bottom end of said tank and exposed to said combustion zone, a venturi tube extending through said skirt into said plenum for the supply of said gas and air thereto, and a pan across the bottom end of said skirt to seal the bottom of said plenum.

2. The improved water heater of claim 1 wherein the perforated ceramic flat plate radiant burner has perforations with a diameter in the range of about 0.076 inch, the total area of said perforations being equal to approximately one-third of the area of the entire face of said burner except for its narrow rim portion by which it is supported.

3. The improved water heater of claim 2 wherein the perforated ceramic flat plate radiant burner is formed of a ceramic fiber matrix and has a thickness of about 0.5 inch.

4. In a water heater having an upright cylindrical water tank with a flue pipe extending therethrough, a cylindrical metal skirt extending downward from the cylindrical wall of said tank for the support thereof, said skirt having a closed bottom end, and a gas burner positioned within said skirt, the improvement comprising a radiant gas burner in the form of a circular perforated ceramic flat plate fitted in said skirt as a transverse partition spaced from the bottom of said tank to provide a combustion zone and spaced from said closed bottom end of said skirt to provide a plenum for fuel gas and air injected thereinto, said ceramic flat plate having a diameter substantially equal to the inside diameter of said skirt and having perforations over its entire face except for a narrow rim portion by which it is supported in said skirt, refractory-type insulation surround said perforations as lining of said skirt between said rim portion and the bottom end of said tank and exposed to said combustion zone, and a venturi tube extending through said skirt into said plenum for the injection of said fuel gas and air.

5. The improvement of claim 4 wherein the circular perforated ceramic flat plate has perforations with a diameter of about 0.076 inch and the total area of said perforations is equal to approximately one-third of the area of the entire face of said plate except for its narrow rim portion by which it is supported.

6. The improvement of claim 4 wherein the circular perforated ceramic flat plate is formed of a ceramic fiber matrix.

7. The improvement of claim 6 wherein the circular perforated ceramic flat plate has a thickness of about 0.5 inch and the perforations of said plate having a diameter of about 0.076 inch and a total area equal to approximately one-third of the area of the entire face of said plate except for its narrow rim portion by which it is supported.

* * * * *

UNITED STATES PATENT AND TRADEMARK OFFICE

CERTIFICATE OF CORRECTION

PATENT NO. : 6,725,811 B1
DATED : April 27, 2004
INVENTOR(S) : Moore et al.

It is certified that error appears in the above-identified patent and that said Letters Patent is hereby corrected as shown below:

Column 1,
Line 10, please change "low NO" to -- low $NO_x$ --.

Signed and Sealed this

Fourteenth Day of September, 2004

JON W. DUDAS
*Director of the United States Patent and Trademark Office*